US005738724A

United States Patent [19]

Metzler

[11] Patent Number: 5,738,724

[45] Date of Patent: Apr. 14, 1998

[54] ACTUATOR ASSEMBLY FOR COATER BLADE LOAD ADJUSTMENT

[75] Inventor: Steven Paul Metzler, Covington, Va.

[73] Assignee: Westvaco Corporation, New York, N.Y.

[21] Appl. No.: 692,718

[22] Filed: Aug. 6, 1996

[51] Int. Cl.[6] ..... B05C 11/02

[52] U.S. Cl. ..... 118/123; 118/126

[58] Field of Search ..... 118/413, 419, 118/126, 123, 261; 15/256.5, 256.51

[56] References Cited

U.S. PATENT DOCUMENTS

| | | | |
|---|---|---|---|
| Re. 33,741 | 11/1991 | Boissevain . | |
| 1,993,055 | 3/1935 | Gerstenberg . | |
| 3,735,730 | 5/1973 | Mitter . | |
| 3,882,817 | 5/1975 | Zink | 118/126 |
| 3,988,988 | 11/1976 | Sable . | |
| 4,463,675 | 8/1984 | Ottenhues . | |
| 4,503,770 | 3/1985 | Cox . | |
| 4,537,650 | 8/1985 | Coons, Jr. . | |
| 4,587,899 | 5/1986 | Theilacker . | |
| 4,854,234 | 8/1989 | Emery et al. . | |
| 4,899,687 | 2/1990 | Sommer et al. . | |
| 5,040,459 | 8/1991 | Rambausek . | |
| 5,052,297 | 10/1991 | Albiez . | |
| 5,159,893 | 11/1992 | Rantanen . | |
| 5,409,534 | 4/1995 | Kustermann . | |
| 5,443,638 | 8/1995 | Gartmann et al. . | |
| 5,454,868 | 10/1995 | Mendez . | |

FOREIGN PATENT DOCUMENTS

| | | |
|---|---|---|
| 63-3955 | 1/1988 | Japan . |
| 9305887 | 4/1993 | WIPO . |

*Primary Examiner*—Brenda A. Lamb
*Attorney, Agent, or Firm*—J. R. McDaniel; R. L. Schmalz

[57] ABSTRACT

This invention relates to load adjustment systems for coater blades. Such structures of this type, generally, employ the use of an actuator assembly to control cross-direction (widthwise) coatweight profiles.

5 Claims, 3 Drawing Sheets

ACTUATOR ASSEMBLY FOR COATER BLADE LOAD ADJUSTMENT

BACKGROUND OF THE INVENTION

1. Field of the Invention

This invention relates to load adjustment systems for coater blades. Such structures of this type, generally, employ the use of an actuator assembly to control cross-direction (widthwise) coatweight profiles.

2. Description of the Related Art

Paper or board manufactured for publication or packaging applications is frequently coated prior to printing. Properties such as opacity, gloss, smoothness and "printability" of a coated sheet are far improved over those of an uncoated sheet. Typically, the coating is applied as a liquid mixture of clay, pigments, starch and/or other binders.

Different types of coaters are used within the papermaking industry, but it is generally accepted that the highest quality coated paper surface is that obtained using a "blade coater". The blade of this type of coater scrapes or "doctors" off excess coating to leave a smooth, glossy surface on the paper sheet. The thickness of the film of coating that remains on the sheet can be regulated by altering the contact force between the blade and the sheet. More particularly, most blade coaters employ adjusting screws equally spaced along the length of the blade so that the coating application can be controlled in a pointwise fashion along the width of the paper machine or finishing line. These adjusting screws, typically, are turned by hand or by a motor.

It is known, in blade coaters, that fully automated control of cross-direction (widthwise) coatweight profiles is done using computer controlled stepper motors to turn the blade load adjusting screws. Process measurement "scanners" can accurately measure CD coat weight profiles with a widthwise resolution of one inch or better. However, the physical size of the stepper motors dictates a spacing between adjustment screws of no less than three inches. Thus, a problem is encountered because the control resolution is limited by the size and spacing of the stepper motors. Also, another problem is that the required large number of motors and lead screws results in an expensive coater. Therefore, a more advantageous coater blade load adjustment system, then, would be presented if the widthwise control resolution could be improved while decreasing cost.

Also, it is known, in coater blade load adjustment systems, to employ an assembly of "pressure tubings" to locally control the contact pressure between a "lamellae packet". Exemplary of such prior art is U.S. Pat. No. 5,454,868 ('868) to B. G. Mendez, entitled "Coating Device". While the '868 reference does teach a means to locally control the contact pressure between a lamellae packet, the physical disposition of the "pressure tubings" is not conducive to widthwise control of the blade contact pressure. This is because the pressure tubings are oriented parallel to the direction of sheet travel and would, thus, apply pressure to the entire vertical section of the blade, instead of a single point across its cross-section. Therefore, a further advantageous blade load adjustment system, then, would be presented if it employed a single compartmented tube oriented parallel to the longitudinal axis of the length of the coater blade in order to provide the proper widthwise control of the blade contact pressure.

Finally, it is known in paper coating controlling systems to employ variable pressure pneumatic actuators. Exemplary of such prior art is U.S. Pat. No. Re. 33,741 ('741) to M. Boissevain, entitled "Apparatus and Method for Controlling the Amount of Coatings on Paper or Other Materials." While the '741 reference teaches that the pneumatic actuator pressure may be varied in response to the determined coating thickness by adjusting the position of the metering element at a plurality of cross-directional positions, there is no smooth transition between actuators to prevent sharp discontinuations in the force applied. Also, the '741 reference discloses a length of approximately twelve inches for the loading tube, where each individual tube comprises four chambers, each three inches long. Clearly, multiple assemblies would be required to cover the full width of the coater. Further, the space between individual assemblies would experience significant load force discontinuity. Therefore, a still further advantageous coating control system would be provided if there was a smooth load force transition along the system while employing a single control system.

It is apparent from the above that there exists a need in the art for a coater blade adjustment system which is inexpensive, and which at least equals the coating characteristics of the known coater blade adjustment system, but which at the same time provides better widthwise control resolution and a smoother load force transition.

It is the purpose of this invention to fulfill this and other needs in the art in a manner more apparent to the skilled artisan once given the following disclosure.

SUMMARY OF THE INVENTION

Generally speaking, this invention fulfills these needs by providing a single unit, coater blade load adjustment system, comprising: a base means; a blade clamping means operatively attached to the base means; a blade means having a first and second edge and a length such that the first edge of the blade is operatively secured by the blade clamping means and the second edge of the blade substantially contacts a sheet to be coated; and a plurality of individually and pneumatically controlled, compartmented blade load adjustment means located across the length of the blade to control a widthwise coatweight profile of the blade wherein the blade load adjustment means includes a positioning rod means operatively connected to the base means and a positioning rod fastening means operatively connected to the positioning rod means for blade adjustment positioning, a backing bar support means operatively connected to the positioning rod means, a holding means operatively connected to the backing bar support means wherein the holding means is further comprised of a channel and a single pneumatic tube means such that the holding means is located a predetermined distance away from said second edge of the blade means and wherein the tube means is further comprised of a plurality of parallelogram-shaped and diagonally oriented chambers located adjacent to each other along a length of the tube means.

In certain preferred embodiments, the blade clamping means includes a blade clamping hose and a bracket. Also, an inflatable profiling tube contains the plurality of individually and pneumatically controlled, compartmented blade load adjustment means. Finally, a positioning rod, positioning rod adjusting means, backing bar and channel are used to retain the inflatable profiling tube.

In another further preferred embodiment, a fully automated control of cross-direction (widthwise) coatweight profiles can be achieved by using the individually and pneumatically controlled, compartmented tube that pushes against the blade to load it against the moving sheet and which provides a smooth force transition between the tube compartments.

The preferred coater blade load adjustment system, according to this invention, offers the following advantages: lightness in weight; ease of assembly and repair; improved automated control of cross-direction (widthwise) coatweight profiles; good economy; a smooth force transition; and increased control resolution. In fact, in many of the preferred embodiments, these factors of ease of assembly and repair, automated control of widthwise coatweight profiles, economy, smooth force transition, and increased control resolution are optimized to an extent that is considerably higher than heretofore achieved in prior, known coater blade load adjustment systems.

The above and other features of the present invention, which will become more apparent as the description proceeds, are best understood by considering the following detailed description in conjunction with the accompanying drawings, wherein like characters represent like parts throughout the several views and in which:

A BRIEF DESCRIPTION OF THE DRAWINGS

Figure 3A:
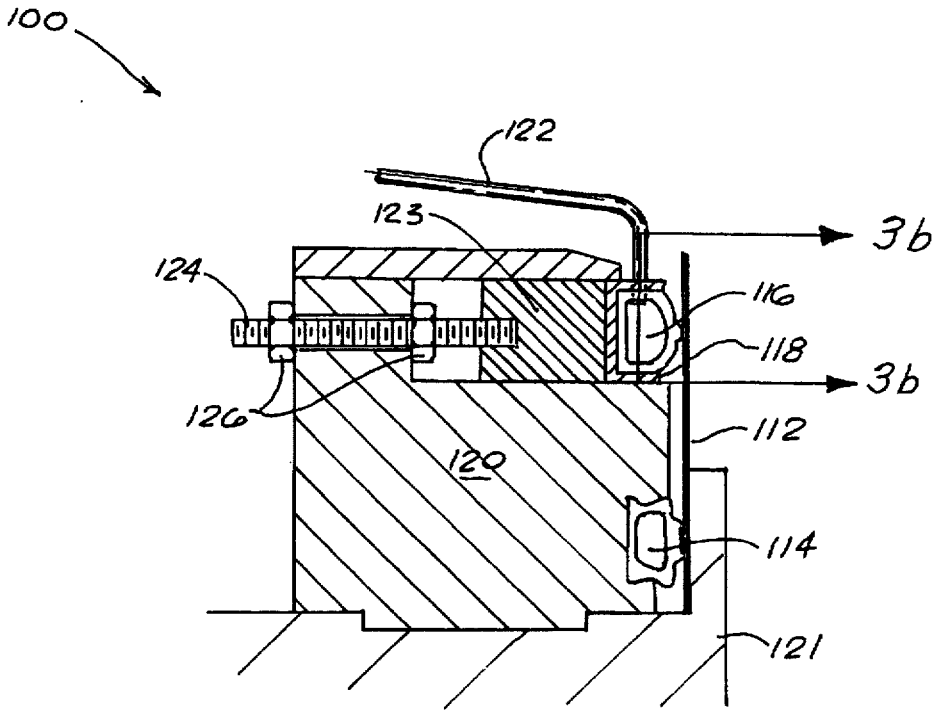
Figure 3B:
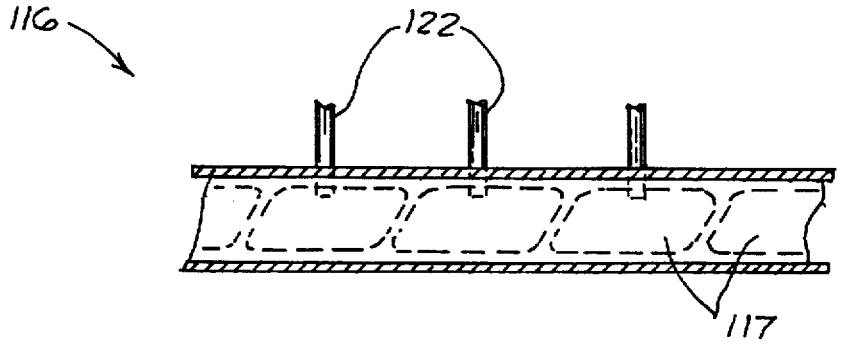
Figure 4A:
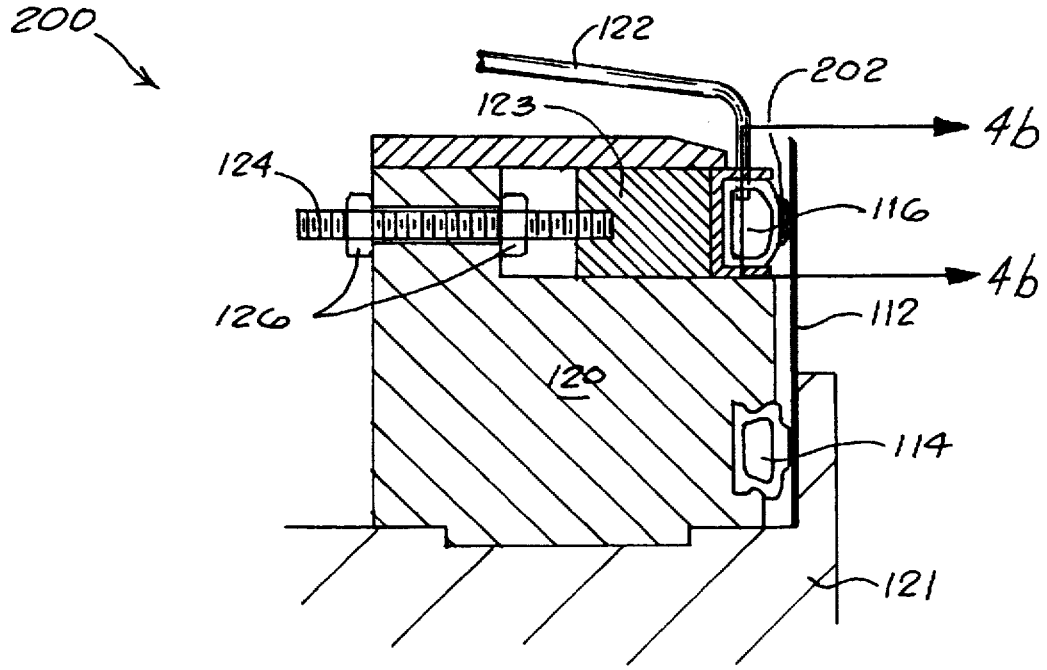
Figure 4B:
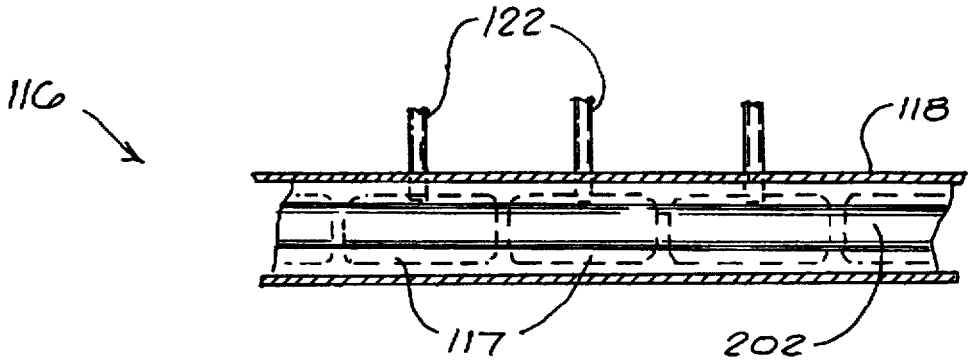

FIG. 3*a* is a cross-sectional view of a coater blade assembly with a pneumatically actuated coater blade loading assembly, according to the present invention;

FIG. 3*b* is a front view of an inflatable profiling tube, taken along line 3*b* in FIG. 3*a*, according to the present invention;

FIG. 4*a* is a cross-sectional view of another embodiment of a pneumatically actuated coater blade loading assembly with a stiffening strip, according to the present invention; and FIG. 4*b* is a front view of an inflatable profiling tube and a stiffening strip taken along lines 4*b* in FIG. 4*a*, according to the present invention.

DETAILED DESCRIPTION OF THE INVENTION

Figure 1:
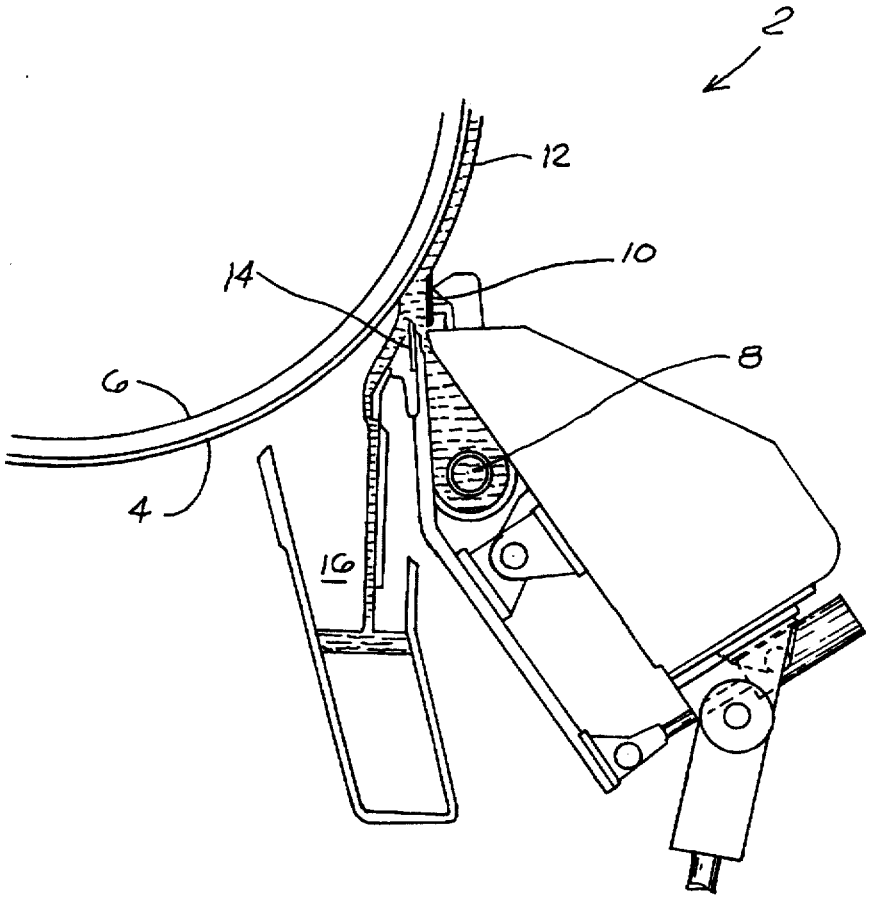
FIG. 1 (PRIOR ART)
FIG. 1 is a cross-sectional view of a conventional blade coater (PRIOR ART)

With reference first to FIG. 1, there is illustrated a cross-sectional view of a conventional blade coater assembly 2. Assembly 2 includes, in part, paper web 4, backing roll 6, coating distribution header 8, coater blade/mount assembly 10, coating film 12 on paper web 4, baffle 14, and trough 16.

During the operation of assembly 2, the paper sheet or web 4, that is being coated, runs upon the surface of backing roll 6. The coating is piped to a distribution header 8 and is applied to the web 4 as it passes underneath blade 10. Blade 10 doctors excess coating off of web 4 to leave a thin coating film 12, the thickness of which is exaggerated in the drawing. Coating not applied to the web 4, flows over a baffle 14 and is collected in a trough 16 for reuse.

It should be noted that the application of coating 12 to web 4 in the manner described above, is known as "short dwell", but is not the only means used to apply a coating to web 4. Another method is to have a second applicator or metering roll (not shown) at or beneath backing roll 6. This metering roll forms a nip (not shown) between backing roll 6 and the metering roll and at the same time is partly immersed in a vat (not shown) of coating. As paper web 4 passes through the nip, web 4 picks up the coating of film carried on the surface of the metering roll, in a manner analogous to a rotary printing press. However, regardless of the coating application method used, a blade is employed to scrape off excess coating as shown in FIG. 1.

Figure 2:
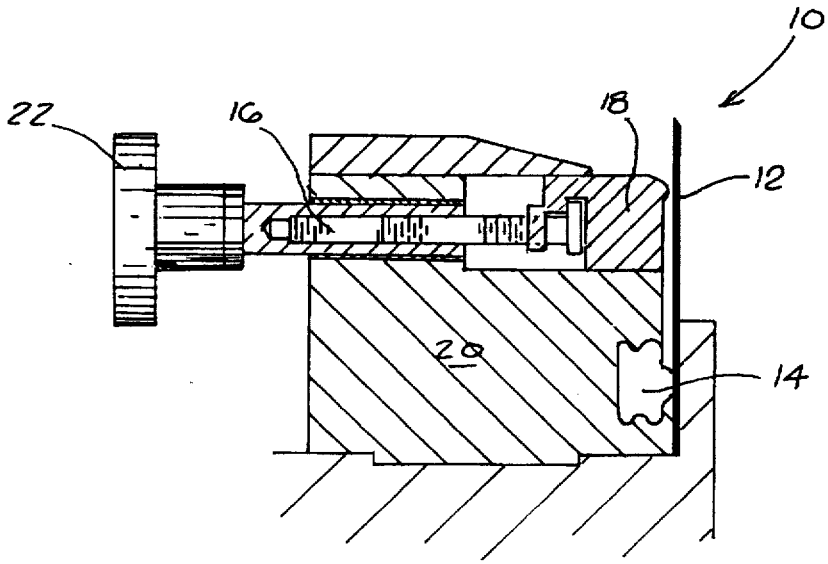
FIG. 2 (PRIOR ART)
FIG. 2 is a cross-sectional view of a conventional coater blade/mount assembly (PRIOR ART)

A closeup view of a conventional mounting/clamping/loading assembly 10 is shown in FIG. 2. However, it is to be understood that the orientation of FIG. 2 is reversed from that of FIG. 1. As shown in FIG. 2, assembly 10 includes, in part, blade 12, blade clamping hose 14, adjusting screw 16, thrust bar 18, base 20, and hand wheel or motor 22. More particularly, blade 12 is clamped all along its length at one edge by inflatable hose 14. Adjusting screws 16 are equally spaced along the length of blade 12 to push on thrust bar 18 to adjust the contact force between one edge of blade 12 and moving web 4 (FIG. 1). This enables pointwise control of the amount of coating 12 (FIG. 1) applied to web 4. Adjusting screws 16 may be turned by hand wheels 22 or they may be motorized for automatic control via a conventional computer setup.

The present invention is shown in FIGS. 3*a* and 3*b*. FIG. 3*a* is a cross-sectional view that illustrates a single unit, pneumatically actuated coater blade loading assembly 100. Assembly 100 includes, in part, conventional blade 112, conventional blade clamping hose 114, inflatable profiling tube 116, channel 118, base 120, conventional bracket 121, pneumatic fluid supply line 122, backing bar 123, positioning rod 124, and positioning rod fasteners 126. Channel 118, base 120, bracket 121, backing bar 123 and rod 124, preferably, are constructed of any suitable metallic material. Tube 116, preferably, is constructed of any suitable elastomeric material.

As discussed before with respect to FIG. 2, coater blade 112 is clamped along its base by inflatable hose 114. But to load the working edge of blade 112 against paper web 4 (FIG. 1), the present invention dispenses with adjusting screws 16 and the hand wheels or motors 5 (FIG. 2) necessary to turn screws 16. The present invention instead employs an inflatable profiling tube 116 contained within channel 118. Also, a backing bar 123 is mounted in place using positioning rods 124 and fasteners 126 located at equal intervals along the length of blade 118. Positioning rods 124 appear almost identical in function to the adjusting screws 16 used in the prior art (FIG. 2), but the number of positioning rods 124 is fewer. Preferably, only one positioning rod 124 for every two or three widthwise control zones will be employed in the present invention. Conversely, in the conventional blade coater assembly 2, there is one adjusting screw 16 for each control zone. Backing bar 123 is not used for profiling purposes, but is made movable only to enable the installation and control range adjustment of different-sized profile tubes 116.

FIG. 3*b* illustrates a front view of inflatable profiling tube 116. In particular, FIG. 3*b* shows how profile tube 116 is partitioned off into separate control chambers 117, each individually pressurized by its own pneumatic fluid supply line 122. Any suitable pneumatic fluid or gas can be used, but air is preferred.

The view of FIG. 3*b* also shows chambers 117 being parallelogram-shaped and diagonally oriented. If chambers 117 are arranged straight up and down, i.e., normal to the axis of profile tube 116, the force applied to blade 112 may have sharp discontinuities between separate chambers 117. However, it is to be understood that this diagonal orientation of chambers 117 may not be necessary for a relatively thick blade 112 that has a longitudinal stiffness sufficient to "bridge over" variations in the applied force.

FIGS. 4*a* and 4*b* show another embodiment of a pneumatically actuated coater blade loading assembly 200 with a stiffening strip 202 incorporated into profiling tube 116. It is to be understood that assembly 200 includes all the parts of assembly 100 except for the addition of stiffening strip 202 incorporated into profiling tube 116. Strip 202, preferably, is constructed of any suitable metallic and/or polymeric material. More particularly, as shown in FIG. 4*a*, strip 202 is bonded directly to the outer face of profile tube 116 by conventional bonding techniques. Strip 202 further smooths and provides a more even distribution of the force applied to blade 112 by assembly 200 than the unmodified profiling tube 116 of FIGS. 3*a* and 3*b*. In this manner, chambers 117 (FIG. 4*b*) may or may not be diagonally oriented because strip 202 adjusts for "bridge over" variations in the applied force.

With respect to the present invention, hand wheel or motor 22 and adjusting screws 16 (FIG. 2) are replaced by an inflatable profile tube 116 (FIGS. 3*a*, 3*b*, 4*a* and 4*b*) that pushes against blade 112 to load blade 112 against the moving paper web 4 (FIG. 2). Tube 116 is separated into a series of short chambers 117. Chambers 117 are individually pressurized to create the desired cross-machine (widthwise) blade load profile. The control zone width (the length of the individual chambers 117) can be as small as one-half of an inch. It is to be understood that conventional transducers may be attached to convert electronic or optical control outputs to pneumatic signals in order to operate assemblies 100 and 200. Thus, assemblies 100 and 200 have virtually no moving parts. Consequently, they are simple to maintain and cost far less than the previously discussed prior art systems.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A single unit, coater blade load adjustment system, wherein said system is comprised of:

a base means;

a blade clamping means operatively attached to said base means;

a blade means having a first and second edge and a length such that said first edge of said blade is operatively secured by said blade clamping means and said second edge of said blade substantially contacts a sheet to be coated; and a blade load adjustment means located across said length of said blade to control a widthwise coatweight profile of said blade wherein said blade load adjustment means includes a positioning rod means operatively connected to said base means and a position rod fastening means operatively connected to said positioning rod means for blade adjustment positioning, a backing bar support means operatively connected to said positioning rod means, a holding means operatively connected to said backing bar support means wherein said holding means is further comprised of a channel and a single pneumatic, profiling tube means such that said holding means is located a predetermined distance away from said second edge of said blade means and wherein said tube means is further comprised of a plurality of parallelogram-shaped diagonally oriented and individually and pneumatically controlled chambers located adjacent to each other along a length of said tube means wherein at least two opposite angles of said parallelogram-shaped chambers are acute angles.

2. The adjustment system, as in claim 1, wherein said blade clamping means is further comprised of:

a blade clamping hose means operatively attached to said base means; and a bracket means located adjacent to said blade clamping hose means.

3. The adjustment system, as in claim 1, wherein said tube means is further comprised of:

a pneumatic fluid supply means operatively connected to said tube means.

4. The adjustment system, as in claim 1, wherein said tube means is further comprised of:

a tube stiffening means operatively connected to said tube means.

5. The adjustment system, as in claim 4, wherein said tube stiffening means is further comprised of:

a stiffening strip.

* * * * *